US005823347A

United States Patent [19]

Mattes

[11] Patent Number: 5,823,347

[45] Date of Patent: Oct. 20, 1998

[54] DEVICE FOR STORING PHOTOGRAPHIC FILM NEGATIVE CASSETTES

[75] Inventor: Peter Mattes, Nettetal, Germany

[73] Assignee: Karl Walther Alben und Rahmen GmbH & Co. KG, Germany

[21] Appl. No.: 749,321

[22] Filed: Nov. 14, 1996

[30] Foreign Application Priority Data

Jul. 5, 1996 [DE] Germany ..... 296 11 711.0
Sep. 2, 1996 [DE] Germany ..... 296 15 075.4

[51] Int. Cl.[6] ..... B65D 85/671

[52] U.S. Cl. ..... 206/555; 206/455

[58] Field of Search ..... 206/454, 455, 206/425, 449, 555, 232

[56] References Cited

U.S. PATENT DOCUMENTS 5,251,746 10/1993 Gresh et al. ..... 206/455
5,546,155 8/1996 Yamamoto ..... 206/455
5,667,071 9/1997 Nakagoshi et al. ..... 206/455

*Primary Examiner*—Jacob K. Ackun
*Attorney, Agent, or Firm*—Mason, Kolehmainen Rathburn & Wyss

[57] ABSTRACT

A device for storing photographic film negative cassettes comprises a receiving container for receiving at least one negative cassette, and a case designed both for the insertion of a photographic album and also for receiving the receiving container. On one side the case has a first opening for insertion of the photographic album and on the opposite side it has a second opening for receiving the receiving container, so that the receiving container is accessible through the second opening for receiving or removing negative cassettes. The second opening can be closed by a pivotable cover.

10 Claims, 3 Drawing Sheets

DEVICE FOR STORING PHOTOGRAPHIC FILM NEGATIVE CASSETTES

FIELD OF THE INVENTION

The invention concerns a device for storing photographic film negative cassettes, comprising a receiving container for receiving at least one negative cassette.

BACKGROUND OF THE INVENTION

Photographic films have recently been put on to the market, which involve the developed film negatives remaining in the film cartridge or cassette. For the sake of convenience in this specification such a film cartridge or cassette containing film negatives will be referred to as a negative cassette.

Accessibility to the film negatives in the film cassette, as is required for the production of positive prints therefrom, is achieved by virtue of using special items of equipment which are usually only available in development laboratories. As therefore the developed film negatives in the negative cassette are not normally accessible to the person wishing to make use of the film or view same, and as therefore the developed film negatives in the negative cassette can also no longer be viewed, the user of the film is faced with the problem of making the appropriate association between film negative and positive print as that person can no longer associate the film negatives with the appropriate positive prints by simply viewing the negatives and comparing them to the prints.

One form of container for storing negative cassettes containing developed films comprises a plurality of compartments which are disposed in juxtaposed relationship, for each receiving a respective negative cassette. The container can be closed by means of a cover, in which situation the individual compartments are jointly closed by closure of the cover. Provided on the inside of the cover of the container is a receiving means of a slot-like configuration, into which prints referred to as contact prints or 'index prints' can be inserted, an overall representation of the content of the film being provided on such index prints. That container however is not suitable for accommodating positive prints in the manner of a photographic album.

SUMMARY OF THE INVENTION

An object of the present invention is to provide a device for storing photographic film negative cassettes which is such as to ensure direct and reliable association of negative cassettes with the corresponding positive prints.

Another object of the present invention is to provide a device for storing photographic film negative cassettes in conjunction with prints taken therefrom in a user-friendly manner.

Another object of the present invention is to provide a device for storing photographic film negative cassettes which is of enhanced versatility in terms of storage facility while nonetheless being easy to operate.

In accordance with the principles of the present invention the foregoing and other objects are attained by a device for storing photographic film negative cassettes, comprising a receiving container for receiving at least one negative cassette. The device further includes a case which is similar to a slip case or jacket for fitting on a book, the case being designed both for the insertion of a photographic album and also for receiving the receiving container with at least one negative cassette therein. At one side the case has a first opening for insertion of the photographic album while at the opposite side it has a second opening for receiving the receiving container. The receiving container is accessible through the second opening, for selective reception or removal of negative cassettes. The second opening can be closed by a cover.

As indicated above, the case for insertion of a photographic album and for receiving and storing the receiving container accommodating at least one negative cassette therein is generally similar to a slip case which usually represents a protective receptacle or jacket for receiving a valuable book, and for that purpose at one side such a case has an opening for insertion of the book into same. The case of the device according to the present invention is thus similar to such a slip case insofar as it is adapted to receive an album containing photographic positive prints, but the case not only has an opening for insertion of the photographic album but at the side opposite the first opening for insertion of the photographic album, the case also has a second opening for receiving the receiving container with at least one negative cassette therein. In that way, both the photographic album containing the positive prints and also the receiving container for receiving at least one negative cassette can be jointly stored in the case, thereby providing for the desired clear association between film negatives and positive prints in a common container. In that respect the receiving container can be fixed in the interior of the case in such a way that it is readily accessible to the user from the second opening, for inserting or removing negative cassettes. The second opening is adapted to be closable, more specifically and preferably by means of a closure cover mounted pivotably at a longitudinal side of the second opening.

In accordance with a preferred feature of the invention the second opening is designed to be inclined with narrow sides extending at an acute angle relative to the edges of the case, which adjoin the longitudinal side of the second opening which carries the closure cover. The closure cover has side portions which are of a configuration such as to increase in width in an inclined shape corresponding to the inclination of the narrow sides of the second opening, and a plate portion which connects the side portions and which is disposed opposite to the pivotal mounting region of the closure cover at the longitudinal side of the second opening.

In that arrangement it is advantageous that, in the closed position of the closure cover or flap, the side of the case which is in opposite relationship to the first opening for insertion of the photographic album has an end surface which extends transversely to the side walls of the case. By virtue of the inclined positioning of the second opening, the receiving container is particularly easily accessible and the facility of reading identifications which are possibly provided on the receiving container is enhanced, more specifically when the case is resting on a surface with its flat side at which the closure cover is pivotably mounted. When the closure cover, with the case in that position, is moved into its open condition, the interior of the receiving container for accommodating at least one negative cassette is particularly easily accessible for a user.

A further preferred embodiment of the invention can provide that the second opening has an arresting means for holding the closure cover in the closed position. The arresting means can be for example in the form of a neck or flange-like portion which extends around the free edge of the second opening and which is of such a configuration that the closure cover, in the closed position, is held against the neck or flange portion with a slight clamping action.

In a preferred embodiment of the invention the receiving container may include a plurality of individual containers for each receiving a respective negative cassette, the individual containers being produced by a deep-drawing process.

A further preferred configuration according to the invention can include receiving means for accommodating index prints, such receiving means being accessible from the outside of the case. In that way the case can also be used for easily accessible storage of the associated index prints.

In a feature of the invention of that preferred embodiment the receiving means may for example be of such a nature that transparent sleeves or holders in the form of overlappingly arranged registers, for receiving index prints, are disposed on at least one flat side of the case, below an at least partially transparent cover means adapted to be pivotable between a closed position and an open position. The cover means is adapted to be arrested in its closed position by arresting means on the respective flat side of the case.

Alternatively or in addition it can be provided that the case has an insertion opening having a viewing window for index prints, on at least one flat side of the case.

Further objects, features and advantages of the invention will be apparent from the following description of preferred embodiments thereof.

DESCRIPTION OF PREFERRED EMBODIMENTS

Figure 1:
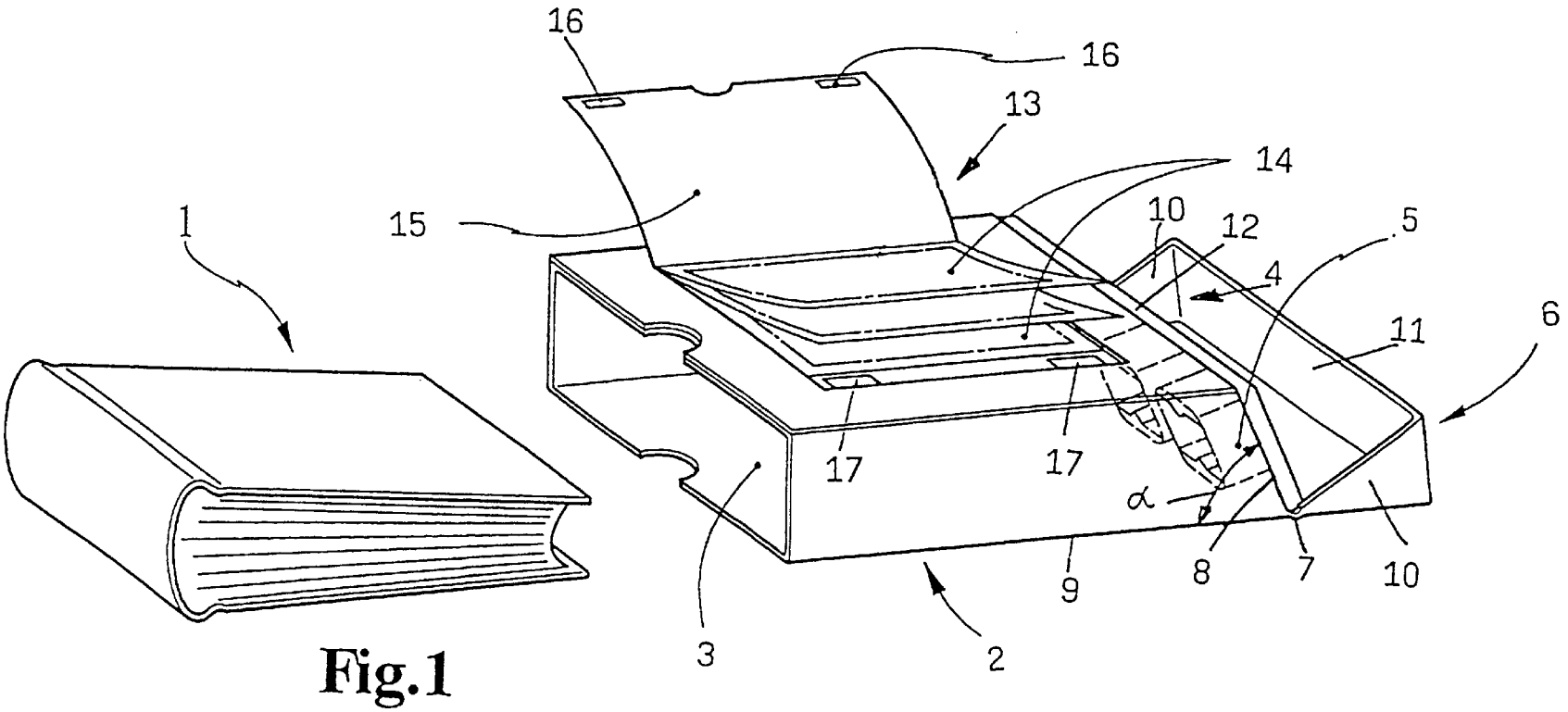
FIG. 1 is an exploded diagrammatic perspective view of an embodiment of a device according to the invention.
Figure 2:
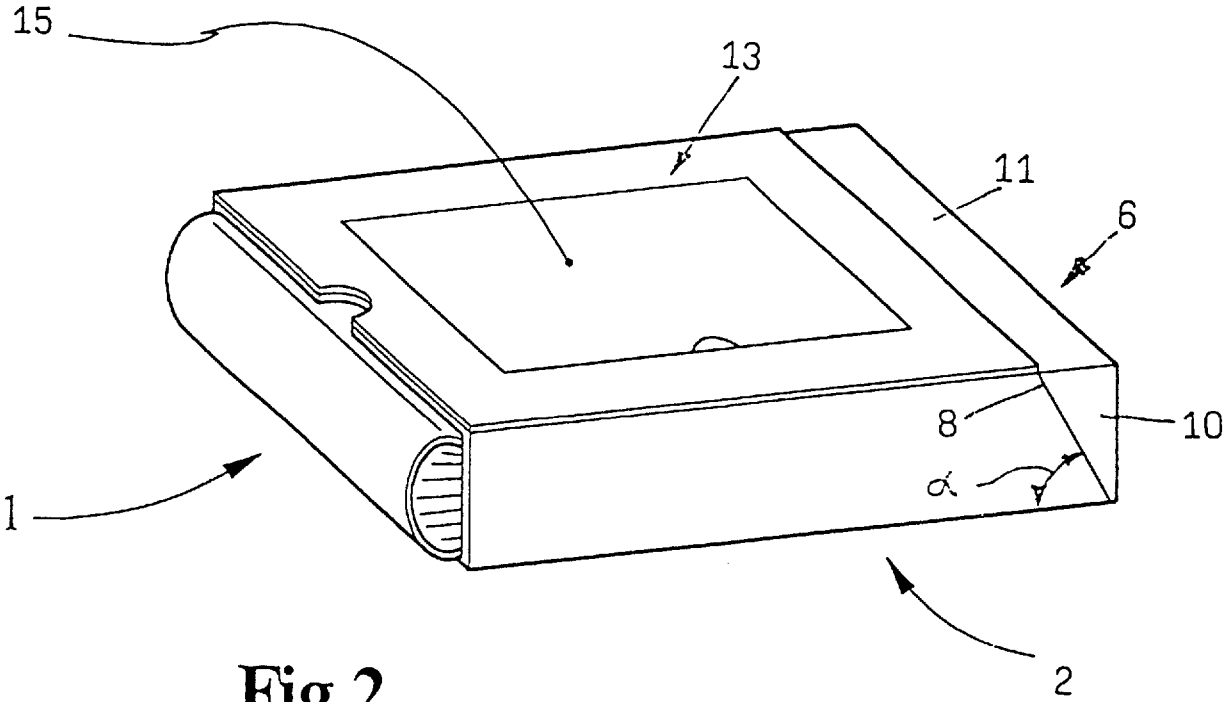
FIG. 2 is a diagrammatic perspective view of the device shown in FIG. 1, but with a photographic album inserted into the case and the closure cover in its closed position.

Reference will first be made to FIGS. 1 and 2 showing a first embodiment of the device according to the invention for storing at least one photographic film negative cassette. In FIGS. 1 and 2, reference numeral 1 denotes a photographic album for accommodating photographic positive prints. Reference numeral 2 denotes a case of the device according to the invention, which, as is clearly apparent from FIGS. 1 and 2, is of a similar configuration to a conventional slip case or cover for accommodating a book for protecting same. At one side, being the side towards the left in FIGS. 1 and 2, the case 2 has a first opening 3 which is in the form of an insertion opening for insertion of the photographic album 1. The photographic album 1 is shown in FIG. 2 in the condition of being inserted into the opening 3. On the other side opposite to the first opening 3, the case 2 of the device according to the invention has a second opening 4 which is adapted to receive a receiving container, identified by reference numeral 5, for containing a plurality of negative cassettes of photographic films. The receiving container 5 is provided with a plurality of individual containers produced by a deep-drawing process, for each receiving a respective negative cassette. Means which are not shown herein may be operatively associated with each individual container of the receiving container 5 for preventing the negative cassette contained in the respective individual container from accidentally falling out of same.

The receiving container 5 is fixed in the case 2 in such a way that the individual containers are readily accessible to the user by way of the second opening 4, for the purposes of selective insertion or removal of respective negative cassettes. It will be appreciated that the interior of the case 2 is of such a size that both the photographic album 1 and also the receiving container 5 have sufficient space for same in the interior of the case 2.

The second opening 4 is adapted to be closable by way of a closure cover 6. The closure cover 6 is in the form of a flap which is pivotably mounted to a longitudinal side as indicated at 7 of the second opening 4. As can be seen from FIG. 1, the second opening 4 is so positioned as to be inclined relative to the general plane of the body of the case 2, in such a way that the narrow sides 8 of the second opening 4 extend at an acute angle $\alpha$ relative to edges 9 which extend between the first opening 3 and the second opening 4 and which adjoin the longitudinal side 7 of the first opening 4, at which the closure cover 6 is pivotably mounted. The closure cover 6 is of a partially box-like configuration, comprising side portions 10 which are of a generally triangular configuration and which thus increase in width away from the pivotal mounting of the closure cover 6 at the longitudinal side 7 of the case 2, in a fashion corresponding to the inclined positioning of the plane of the opening 4, and a plate portion 11 which connects the side portions 10. By virtue of the configuration of the side portions 10 in conjunction with the inclined positioning of the opening 4 therefore, as can be seen from FIG. 2 when the closure cover 6 is closed the co-operation of the closure cover 6 with the opening 4 provides a right-angled configuration at that end of the case 2.

In order to hold the closure cover 6 in an arrested condition in the closed position thereof, the device has an arresting means as generally indicated at 12, which is in the form of a neck or flange-like portion which extends around the free region of the opening 4 at the inside thereof. It will be readily apparent that the arresting means 12 holds the closure cover 6 fast in its closed position, as shown in FIG. 2, by virtue of a slight clamping action between the inside surfaces of the closure cover 6 and the flange portion of the arresting means 12.

As shown in FIG. 1 the inclinedly positioned second opening 4 and the corresponding configuration of the closure cover 6, in the open position of the latter, provide for particularly easy accessibility to the receiving container disposed in the opening 4, while also permitting any identifications that may be provided thereon, for example for identifying respective negative cassettes contained in the receiving container, to be easily read off.

Provided on the outside of the case 2 is a receiving means which is generally identified by reference numeral 13 in FIGS. 1 and 2 for receiving contact prints or prints referred to as 'index prints', representing the entire respective film content. In the embodiment shown in FIGS. 1 and 2 the receiving means 13 has a register arrangement comprising transparent sleeves or holders 14 in the form of mutually overlappingly arranged registers into which the index prints of the individual negative cassettes can be inserted. In that respect the number of transparent sleeves or holders 14 corresponds to the number of respectively provided individual containers in the receiving container for accommodating the negative cassettes. The transparent sleeves or holders 14 are disposed beneath an at least partially transparent cover portion 15 which is pivotable upwardly from the closed position shown in FIG. 2 into an open position as shown in FIG. 1, and which can be arrested in the closed position by arresting means 16 which are for example in the form of hook-and-loop closure means, on corresponding regions 17 of the top flat surface of the case 2.

Figure 3:
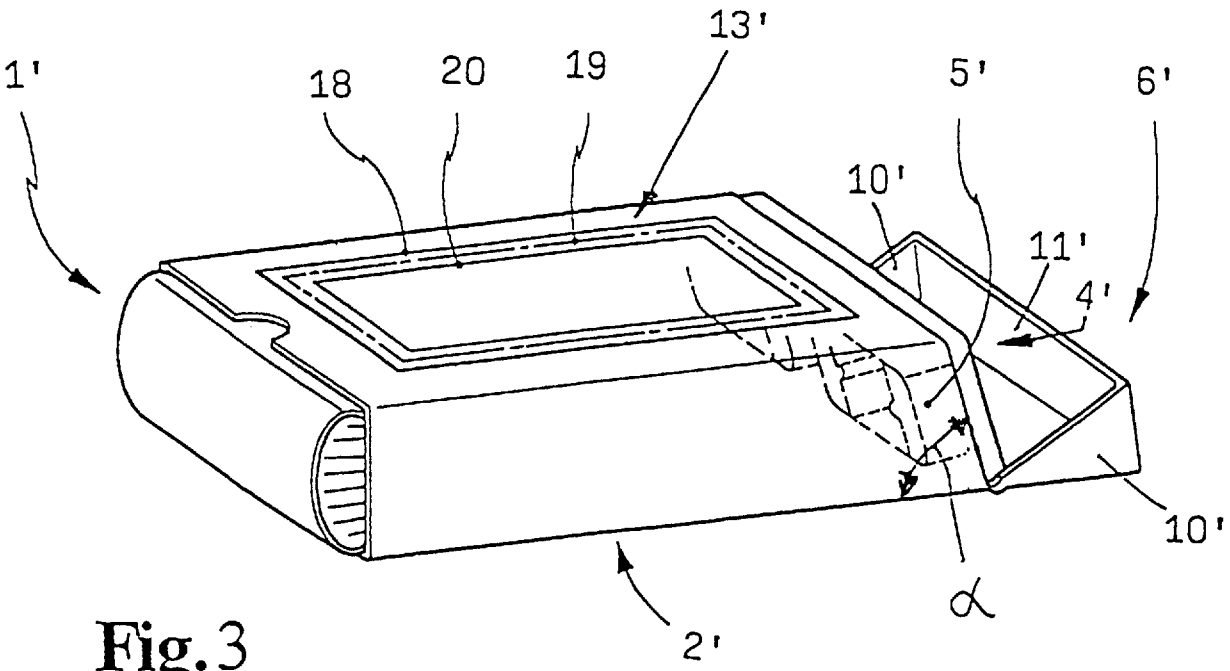
FIG. 3 is a diagrammatic perspective view of a further embodiment of the invention with a photographic album inserted into the case thereof, with the closure cover in the open position thereof.

Referring now to FIG. 3, shown therein is a further embodiment of the device according to the invention in which the parts or components which correspond in principle to the embodiment of FIGS. 1 and 2 are identified by references supplemented by a prime and which for that reason will not be described once again separately hereinafter. Apart from different formats and sizes in respect of the respective photo albums 1, 1', the cases 2, 2' and the receiving containers 5, 5' respectively, in this embodiment receiving means 13' for receiving index prints are provided on oppositely disposed flat sides of the case 2'. As the receiving container 5' in this embodiment is subdivided into only two individual containers, in this case there is no need for the receiving means 13' for the index prints to be in the form of separate overlappingly arranged register sleeves or holders as indicated at 14 in the embodiment of FIGS. 1 and 2, but on the contrary it is sufficient if each of the two oppositely disposed flat sides of the case 2' has receiving means 13' each having a respective insertion opening 18 into which index prints 19 can be inserted and can then be viewed through a viewing window 20.

It will be appreciated that the above-described embodiments of the device according to the invention have been set forth solely by way of example and illustration of the principles thereof and that various other modifications and alterations may be made therein without thereby departing from the spirit and scope of the present invention.

What is claimed is:

1. A device for storing negative cassettes of photographic films, comprising a receiving container means for receiving at least one negative cassette, a case having first and second sides and including a first opening at the first side for insertion of a photographic album to be accommodated in the case and a second opening at the second side for receiving the receiving container means whereby the receiving container means is accessible through the second opening for selective reception and removal of negative cassettes, and means for closing the second opening.

2. A device as set forth in claim 1 wherein the first and second sides of the case are mutually opposite sides thereof.

3. A device as set forth in claim 1 wherein the second opening has a longitudinal side and the closure means includes a closure cover mounted pivotably at the longitudinal side of the second opening.

4. A device as set forth in claim 3 wherein the case has edges extending between the first and second openings and adjoining said longitudinal side of the second opening and the second opening includes narrow sides disposed inclinedly at an acute angle relative to said edges of the case whereby the second opening is disposed inclinedly relative to said edges of the case, and wherein the closure cover includes side portions of a configuration that increases in width away from the pivot mounting of the closure cover on the case whereby the side portions match the inclined positioning of the narrow sides of the second opening, the closure cover further including a plate portion connecting said side portions and disposed opposite the pivot mounting of the closure cover.

5. A device as set forth in claim 1 wherein the second opening has an arresting means for holding the closure cover in a closed position thereof.

6. A device as set forth in claim 1 wherein the receiving container means includes a plurality of individual containers for each receiving a respective negative cassette, said individual containers being produced by a deep-drawing process.

7. A device as set forth in claim 1 including receiving means for index prints, said receiving means being accessible from the outside of the case.

8. A device as set forth in claim 7 wherein said receiving means include transparent holders in the form of mutually overlapping register sleeves for receiving index prints on at least one flat side of the case, and further including an at least partially transparent cover means which is adapted to be pivotable between a closed position and an open position, and arresting means on the respective flat side of the case operable to hold the cover means in the closed position thereof.

9. A device as set forth in claim 7 and further including an insertion opening having a viewing window for index prints, on at least one flat side of the case.

10. A device for storing photographic film negative cassettes in conjunction with a photographic album, comprising a receiving container for accommodating at least one said negative cassette, a case of generally box-like configuration comprising first and second large sides and first and second narrow sides each disposed substantially at a right angle to each other, the case having first and second ends and a first opening at the first end and a second opening at the second end, a first compartment within the case for accommodating a photographic album insertable into said first compartment by way of said first opening and a second compartment within said case for accommodating said receiving container insertable into said second compartment by way of said second opening, a cover means mounted to said case displaceably between a closed position of closing said second opening and a second position of opening said second opening, and means for retaining said cover means in its closed position.

* * * * *